US010571830B2

(12) United States Patent
Nelson et al.

(10) Patent No.: US 10,571,830 B2
(45) Date of Patent: Feb. 25, 2020

(54) MOUNTING SURFACES FOR WIPER BLADES

(71) Applicant: HP Indigo B.V., Amstelveen (NL)

(72) Inventors: Eric G. Nelson, Boise, ID (US); Lavi Cohen, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/402,311

(22) Filed: May 3, 2019

(65) Prior Publication Data

US 2019/0258193 A1 Aug. 22, 2019

Related U.S. Application Data

(63) Continuation of application No. 15/748,637, filed as application No. PCT/US2016/015635 on Jan. 29, 2016, now Pat. No. 10,310,417.

(51) Int. Cl.

| | |
|---|---|
| ***G03G 15/10*** | (2006.01) |
| ***G03G 15/095*** | (2006.01) |
| ***G03G 15/11*** | (2006.01) |
| *G03G 15/08* | (2006.01) |

(52) U.S. Cl.

CPC ..... *G03G 15/095* (2013.01); *G03G 15/11* (2013.01); *G03G 15/0812* (2013.01); *G03G 15/104* (2013.01)

(58) Field of Classification Search

CPC ..... G03G 15/11
USPC ..... 399/249, 351
See application file for complete search history.

(56) References Cited

U.S. PATENT DOCUMENTS

| | | | | |
|---|---|---|---|---|
| 5,341,741 | A | 8/1994 | Schneider et al. | |
| 6,223,014 | B1 | 4/2001 | Niwano et al. | |
| 6,813,466 | B1 | 11/2004 | Kopecky | |
| 7,610,008 | B2 | 10/2009 | Watanabe et al. | |
| 7,668,488 | B2 | 2/2010 | Guzman | |
| 8,275,301 | B2 | 9/2012 | Watanabe et al. | |
| 10,310,417 | B2 * | 6/2019 | Nelson et al. | G03G 15/11 |
| 2005/0088480 | A1 | 4/2005 | Wouters | |
| 2005/0201781 | A1 | 9/2005 | Macmillan et al. | |
| 2009/0097883 | A1 | 4/2009 | Guzman et al. | |
| 2011/0041278 | A1 | 2/2011 | Moncavage | |
| 2011/0311286 | A1 | 12/2011 | Thayer et al. | |

(Continued)

FOREIGN PATENT DOCUMENTS

| | | |
|---|---|---|
| CN | 102858545 | 1/2013 |
| CN | 103180054 | 6/2013 |
| CN | 103676137 | 3/2014 |

(Continued)

OTHER PUBLICATIONS

Warner, B., "Uniform Doctor Blade Metering", Jun. 2012, Available online: http://www.allisonblades.com/Documents/FLEXO_June2012.pdf.

*Primary Examiner* — William J Royer
(74) *Attorney, Agent, or Firm* — Wall & Tong LLP

(57) ABSTRACT

In example implementations, an apparatus includes a planar surface, a curved mounting surface and a wiper blade. The curved mounting surface may be coupled adjacent to the planar surface. The wiper blade may be clamped to the planar surface. A bottom of the wiper blade can rest on the curved mounting surface such that a free length of the wiper blade is different at a plurality of points along a width of the wiper blade.

15 Claims, 5 Drawing Sheets

(56) References Cited

U.S. PATENT DOCUMENTS

2015/0331384 A1 11/2015 Kato

FOREIGN PATENT DOCUMENTS

| | | | |
|---|---|---|---|
| CN | 204020238 | | 12/2014 |
| DE | 102007025982 | | 12/2008 |
| EP | 1679556 | A1 | 7/2006 |
| JP | S56139173 | U | 10/1981 |
| JP | 2604502 | | 8/1994 |
| JP | 2005144906 | | 6/2005 |

* cited by examiner

MOUNTING SURFACES FOR WIPER BLADES

CROSS-REFERENCE TO RELATED APPLICATIONS

This application is a continuation of U.S. patent application Ser. No. 15/748,637, filed on Jan. 29, 2018, which is a 371(c) National Phase application of International Application No. PCT/US2016/015635, filed Jan. 29, 2016, both of which are herein incorporated by reference in their entireties.

BACKGROUND

Printers have different systems of rollers, transfer sections and paper handlers. One section of the printer may be a binary ink developer (BID). The BID may develop printing fluid onto a developer roller. The printing fluid may then be transferred from the BID to a laser written photo imaging plate. In areas where the image has not been written, there may be waste printing fluid that is removed before the next development cycle.

DETAILED DESCRIPTION

The present disclosure discloses a wiper blade holder that is configured to control an angle of attack and a tip force of the wiper blade along a length of the wiper blade. As noted above, printers have different systems of rollers, transfer sections and paper handlers. One section of the printer may be a binary ink developer (BID). The BID may develop printing fluid (e.g., ink) onto a developer roller. The printing fluid may then be transferred from the BID to a laser written photo imaging plate. In areas where the image has not been written, there may be waste printing fluid that is removed before the next development cycle.

A wiper blade is used to remove the printing fluid off of a cleaner roller that is used to remove residual printing fluid off of a developer roller. Initially, the wiper blade can be positioned such that an amount of tip force and the angle of attack are uniform along a length of the wiper blade and the cleaner roller. However, when a pre-load force is applied, or a force of the cleaner roller that rotates against the wiper blade, the wiper blade holder can become deformed causing the angle of attack and the tip force along the width of the wiper blade to change. In other words, the angle of attack and the amount of tip force can be different moving from a front side of the wiper blade to a back side of the wiper blade. In other words, the angle of attack and the amount of tip force may be different at the ends of the wiper blade compared to a center of the wiper blade. The variation of the angle of attack and the amount of tip force along the width of the wiper blade may cause the wiper blade to improperly clean the cleaner roller.

In one implementation, the present disclosure provides a curved mounting surface on the wiper blade holder that helps to maintain an even angle of attack along a width of the cleaner roller and wiper blade when the wiper blade holder becomes deformed due to a pre-load force that is applied against the wiper blade holder. In other implementations, the present disclosure provides a non-planar surface on the wiper blade holder on which the wiper blade is clamped to also maintain an even angle of attack and an even amount of tip force along a width of the cleaner roller and wiper blade when the wiper blade holder is deformed by the pre-load force. In some implementations, either the curved mounting surface can be used, the non-planar surface can be used, or a combination of both the curved mounting surface and the non-planar surface can be used.

Figure 1:
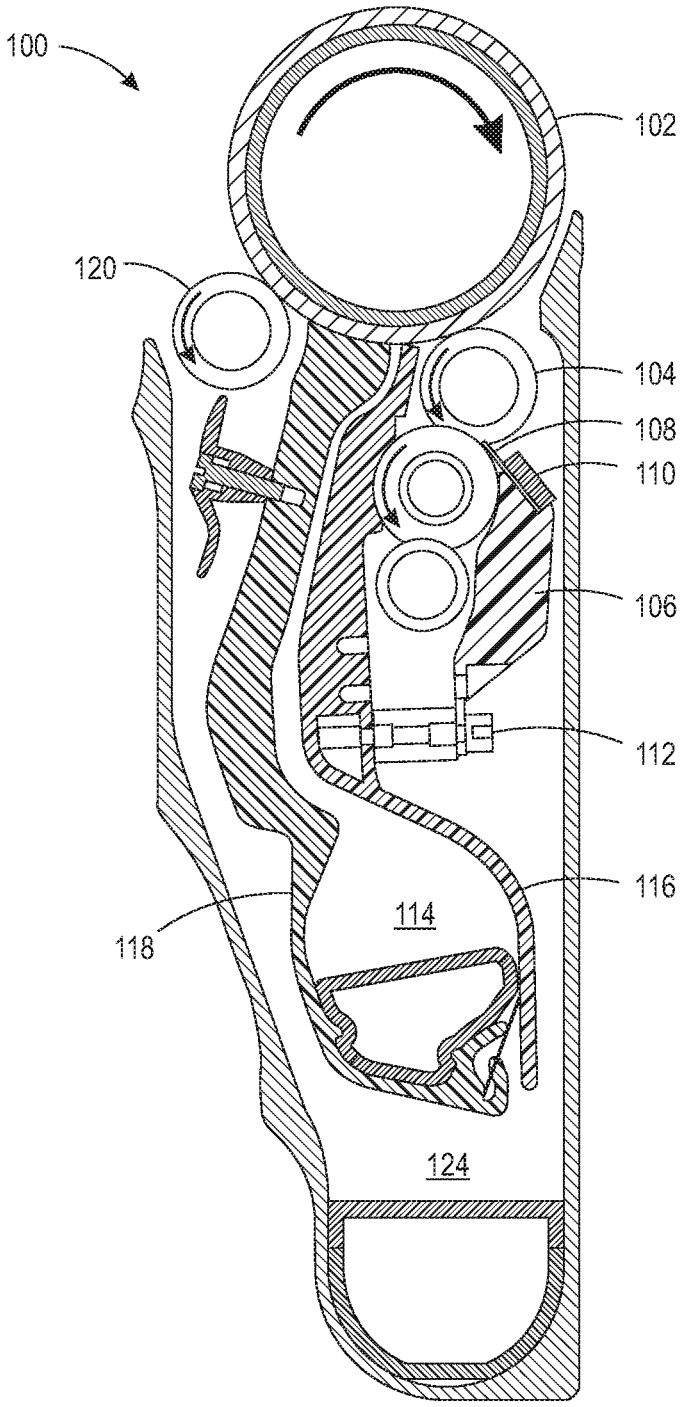
FIG. 1 is a diagram of an example cross section of a binary ink developer (BID) of a printer.

FIG. 1 illustrates an example binary ink developer (BID) cross-section 100 of a printer. The BID 100 includes a fluid cavity 114 located between a back electrode 116 and a main electrode 118. In one example, printing fluid may be moved up between the back electrode 116 and the main electrode 118 towards a developer roller 102. In one example, the developer roller 102 may be a conductive or metallic shaft (e.g., a hollow steel core) with a polyurethane layer molded thereon. The developer roller 102 may be electrically biased to have a large voltage differential (e.g., −800 Volts (V)) between the main electrode 118 and the developer roller 102. Using the voltage differential, the printing fluid may be developed onto the developer roller 102.

A squeegee roller 120 may mechanically and electrostatically remove excess oils from the developer roller 102 leaving a thin layer of printing fluid. For example, the squeegee roller 120 may also have a voltage differential from the developer (e.g., approximately −375 V). The remaining thin layer of printing fluid may be a high density ink that is approximately 6 microns thick and approximately 20% solids.

The printing fluid may then be transferred from the developer roller 102 to a laser written photo imaging plate (not shown). The printing fluid that is not transferred to the photo imaging plate is excess printing fluid that is removed. A cleaner roller 104 located adjacent to the developer roller 102 may be used to remove the excess printing fluid using an electrostatic process. For example, the cleaner roller 104 may have a voltage differential from the developer roller 102 (e.g., approximately +325 V). In one example, the cleaner roller 104 may spin or roll in a direction that is opposite a spin direction of the developer roller 102.

A wiper blade 108 may be used to scrape the printing fluid off of the cleaner roller 104. The printing fluid that is scraped off of the cleaner roller 104 may be mixed with the excess low density printing fluid that overflows to the back side of the back electrode 116 and returned to a catch tray 124 to be recycled.

In one example, the wiper blade 108 may be coupled to the wiper blade holder 106 via a clamp 110. In other words, the wiper blade 108 may be held in place by the wiper blade holder 106 and the clamp 110. In one example, the wiper blade holder 106 may be coupled to a fixed portion of the BID 100 via a mechanical fastener 112 (e.g., a bolt, screw, and the like). The mechanical fastener 112 may be tightened to apply a pre-load to the wiper blade 108 such that the wiper blade 108 presses against the surface of the cleaner roller 104. It should be noted that FIG. 1 has been simplified for ease of explanation and that the printer 100 may include additional sections and features not shown.

In one implementation, the wiper blade holder 106 and the wiper blade 108 may be relatively thin having a large width (e.g., approximately 770 millimeters (mm)) and a short height (e.g., approximately 65 mm). In addition, the wiper blade holder 106 may be secured in the BID 100 by bolts, pins, or any other mechanical fastener on opposite ends. However, due to the geometry of the wiper blade holder 106 and the wiper blade 108 and how the wiper blade holder 106 is secured by the ends in the BID 100, the wiper blade holder 106 can deform under the pre-load force. As a result of the deformation, the angle of attack and the tip force applied by the wiper blade 108 against the cleaner roller 104 may become uneven. The tip force holds the wiper blade 108 against the cleaner roller 104. A proper angle of attack ensures proper scraping of the cleaner roller 104.

When the angle of attack and the tip force applied by the wiper blade 108 against the cleaner roller 104 become uneven, the wiper blade 108 may not clean the surface of the cleaner roller 104. For example, some areas of the wiper blade 108 that have less tip force may leave a streak of printing fluid, or if the angle of attack is too low causing the printing fluid to smear rather than being wiped off.

The present disclosure provides the wiper blade holder 106 that is designed to maintain the proper tip force and angle of attack of the wiper blade 108 across the width of the cleaner roller 104. The design of the wiper blade holder 106 compensates for the deformation caused by a pre-load force that allows the proper tip force and angle of attack to be maintained across the width of the cleaner roller 104 even as a portion of the wiper blade holder 106 deforms.

Figure 2:
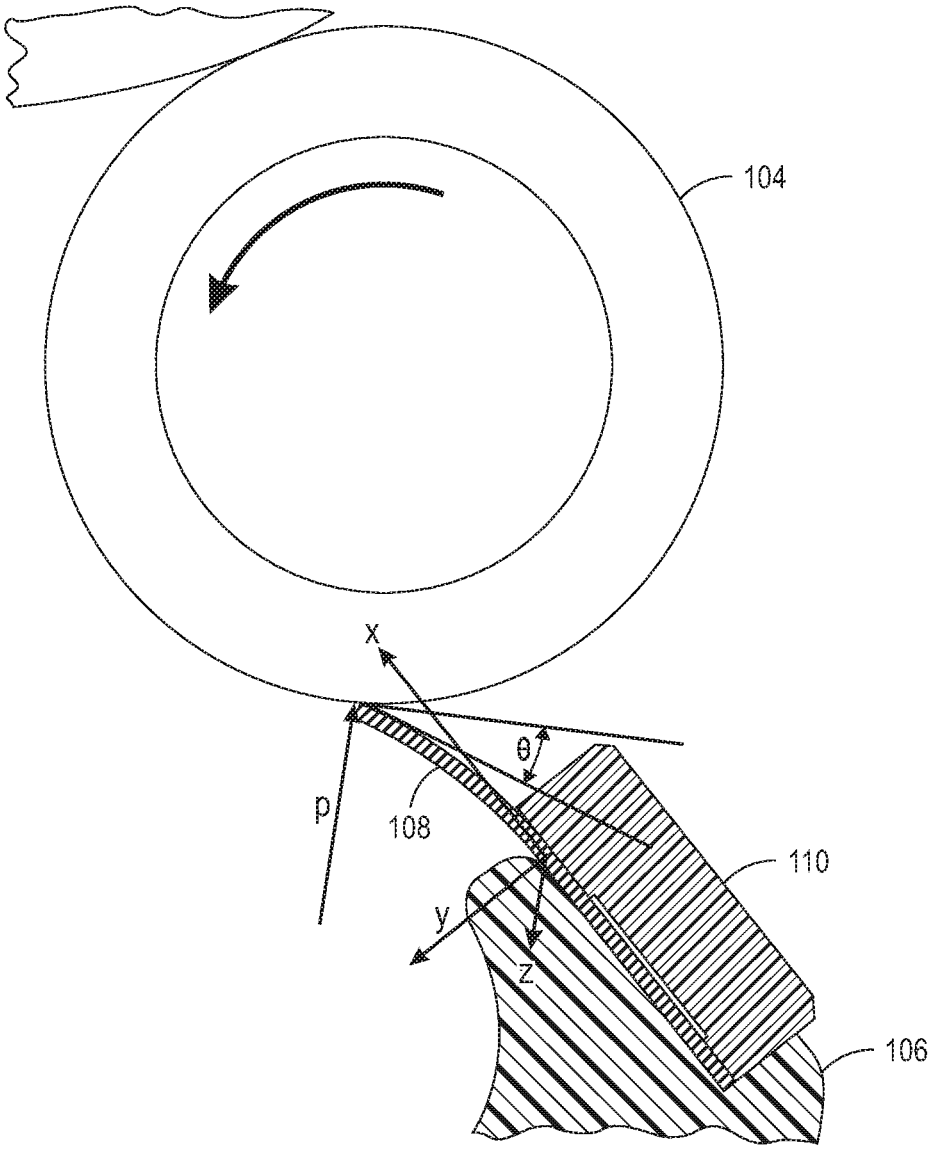
FIG. 2 is an example of an apparatus of the present disclosure relative to a cleaner roller that illustrates example parameters relative to a wiper blade.

FIG. 2 illustrates an example x, y, z coordinate system and an illustration of various parameters to aid in the understanding of the present disclosure. In one example, P illustrates a direction of the tip force and θ illustrates an angle of attack.

In one example, a free length and a deflection can be controlled by modifying a curvature of a mounting surface of the wiper blade holder 106 and/or a planar surface of the wiper blade holder 106 on which the wiper blade 108 is clamped.

Figure 3:
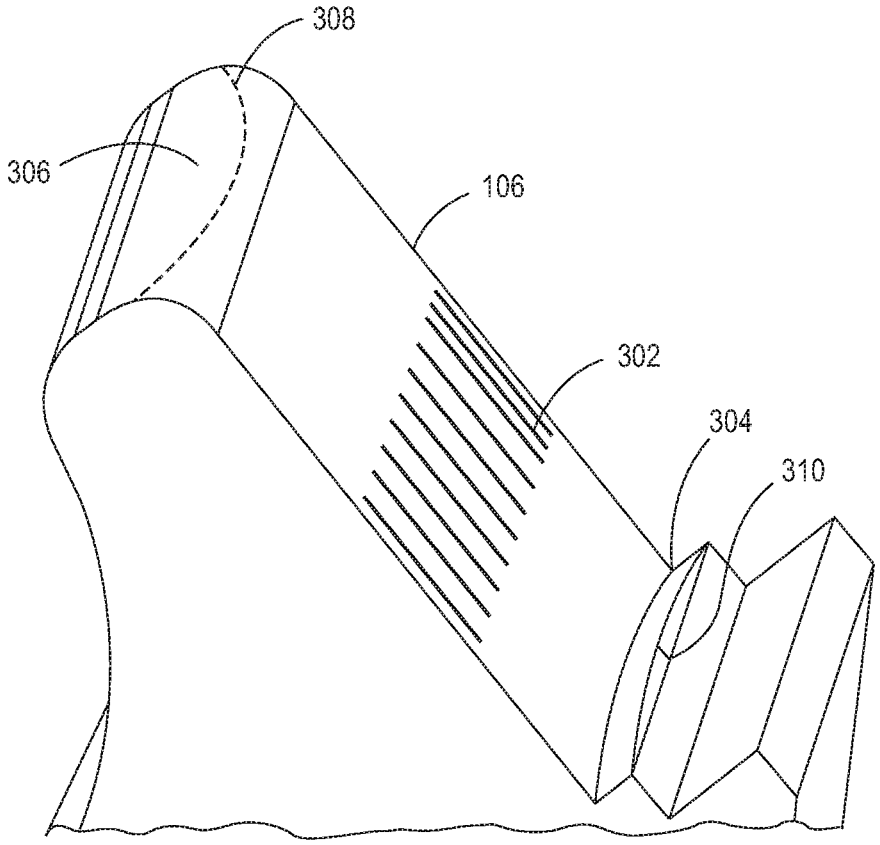
FIG. 3 is an example of the apparatus with a curved mounting surface.

FIG. 3 illustrates an example wiper blade holder 106 of the present disclosure. The wiper blade holder 106 may include a planar surface 302 on which the wiper blade 108 is clamped. In other words, the planar surface 302 has a flat surface that is parallel to a surface of the wiper blade 108.

The wiper blade holder 106 may become deformed. In one example, a top portion 306 of the wiper blade holder 106 may become deformed as indicated by a dashed line 308. For example, the deformation of the top portion 306 may have a bow shape similar to the dashed line 308. Other portions of the wiper blade holder 106 (e.g., the planar surface 302) may become deformed similarly. Said another way, the pre-load force that is applied may cause the wiper blade holder 106 to deform downwards along the x-axis and to the left along the y-axis towards a center of portion of the z-axis. As the wiper blade holder 106 becomes deformed, the wiper blade 108 may bow as well. The bowing of the wiper blade 108 may cause the tip force and the angle of attack of the wiper blade 108 relative to the cleaner roller 104 to change along a width of the wiper blade 108 and cleaner roller 104.

To maintain a consistent angle of attack along the width (e.g., the dimension along the z-axis) of the wiper blade 108 and the cleaner roller 104 as the wiper blade holder 106 becomes deformed, a mounting surface 304 of the wiper blade holder 106 may be modified to have a curvature. A bottom of the wiper blade 108 may rest along the mounting surface 304. In one implementation, the curvature may be added as a separate component to the mounting surface 304. In another implementation, the curvature may be manufactured as part of the mounting surface 304. The shape of the curvature may be parabolic or in any other shape.

In one example, the amount of curvature may be defined by a height 310 at a center of the mounting surface 304. The amount of curvature may be enough to maintain a consistent tip force and angle of attack when the wiper blade holder 106 becomes deformed and small enough such that the wiper blade 108 can conform to the curvature. In one example, the height may be approximately 0.35 millimeters (mm).

However, the height of the curvature may vary depending on a variety of factors. In one example, the amount of curvature, or the height of the center of the mounting surface 304, may be a function of a width (e.g., the dimension along the z-axis) of the BID 100, a stiffness of the wiper blade holder 106 and the wiper blade 108, which may be a function of, how the wiper blade holder 106 is held in place, a type of material used, a geometry (e.g., thick versus thin, wide versus narrow, and the like), and an amount of pre-load force that is applied to the wiper blade holder 106.

In one example, the above parameters may be obtained for a particular BID 100 and used as parameters for a finite element model. Given the known parameters, a modeling function (e.g., a finite element model, or any other modeling function) may be used to calculate the correct height for the curvature.

Adding the curvature to the mounting surface 304 may help control a free length of the wiper blade 108. For example, as noted above, the bottom of the wiper blade 108 rests on the mounting surface 304. When curvature is added to the mounting surface 304, the top of the wiper blade 108 may reflect the same curvature instead of being flat across the width of the wiper blade 108.

Said another way, referring back to FIG. 2, the curvature of the mounting surface 304 would cause the origin of the x, y axis to change along the z axis (e.g., into the page). In other words, to compensate for the deformation of the wiper blade holder 106 downward along the x-axis and to the left along the y-axis, the curvature may move the origin of the x, y axis to begin up higher along the x-axis towards a middle of the width (e.g., the dimension along the z-axis) of the wiper blade 108. As a result, the free length and the deflection of the wiper blade 108 may be controlled to compensate for the changes caused by the deformation of the wiper blade holder 106. For example, the mounting surface 304 having a curve may change a free length of the wiper blade 108 to be different at a plurality of points along a width of the wiper blade 108.

Figure 4:
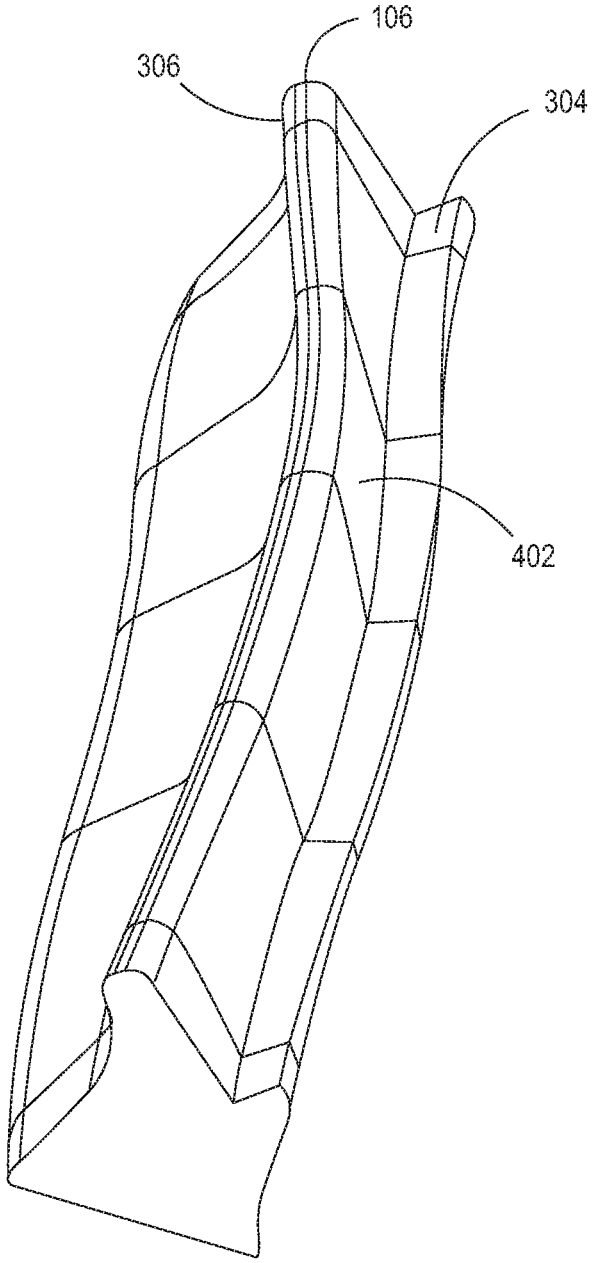
FIG. 4 is an example of the apparatus with a non-planar surface.

FIG. 4 illustrates another example of the wiper blade holder 106 of the present disclosure. It should be noted that FIG. 4 is not drawn to scale and is for illustrative purposes. In one example, the wiper blade holder 106 may be further modified to include a non-planar surface 402 on which the wiper blade 108 rests. In one example, the non-planar surface 402 may be a smooth and continuous surface. In one example, when the non-planar surface 402 is deployed, the clamp 110 may have a shape that corresponds to the non-planar surface 402. As a result, when the clamp 110 is applied to the wiper blade 108 to hold the wiper blade 108 to the wiper blade holder 106, the wiper blade 108 may conform to a shape similar to the non-planar surface 402.

In another example, the wiper blade holder 106 may be modified to add a curvature to the top portion 306. The curvature to the top portion 306 may be contained within the non-planar surface 402. In other words, the curvature to the top portion 306 may be added as an elaboration to the non-planar surface 402.

As discussed above, the pre-load force may cause the wiper blade holder 106 to deform a center part (e.g., center of the z-axis) downwards along the x-axis and left in the y-axis. As a result, the curvature in conjunction with the curvature of the mounting surface 304 may fully compensate for the deformation.

Although, FIG. 4 illustrates the wiper blade holder 106 with the non-planar mounting surface 402, it should be noted that the wiper blade holder 106 may be deployed with any one, or any combination of, the non-planar surface 402, adding curvature to the top portion 306, or the mounting surface 304 that is curved illustrated in FIG. 3. In one example, the non-planar surface 402 may be coupled to the planar surface 302, or may be manufactured as a single, or unitary, piece as shown in FIG. 4.

In one example, the non-planar surface 402 may be a non-planar shape having a curve as illustrated in FIG. 4. In another example, the non-planar surface 402 may be a plurality of individual shapes of different sizes and curvatures across a width of the non-planar surface 402. For example, the size and shape of the plurality of individual shapes or the slope of curvature of the non-planar shape may be based on an amount of translation and/or rotation of the x, y axis that is desired at different locations along a width of the wiper blade.

For example, referring to FIG. 2, the non-planar surface 402 varies the orientation of the x, y axis along the z-axis (e.g., into the page). As curvature is introduced into the non-planar surface 402, the orientation of the x, y axis may rotate left or right around the z-axis. The non-planar surface 402 can achieve full control over tip-force and angle of attack. For example, the non-planar surface 402 may allow the free length and the deflection to be controlled based on the variations in the non-planar surface 402 across a width of the wiper blade holder 106. In one example, adding a curvature to the top portion 306 may achieve full control over the tip force or an angle of attack.

In one example, the amount of curvature in the shape, or number of shapes, of the non-planar surface 402 and the amount of curvature that can be added to the top portion 306 may be designed based on simulations using a finite element model, or other model, as described above. For example, given the known parameters of a width (e.g., the dimension along the z-axis) of the BID 100, a stiffness of the wiper blade holder 106 and the wiper blade 108, which may be a function of a type of material used, a geometry (e.g., thick versus thin, wide versus narrow, and the like), and an amount of pre-load force that is applied to the wiper blade holder 106 for a particular BID 100, the modeling function (e.g., the finite element model, or any other modeling function) can be used to calculate the shape, or number of shapes, of the non-planar surface 402 or an amount of curvature that can be added to the top portion 306 to maintain a proper amount of tip force and angle of attack across a width of the wiper blade 108 and the cleaner roller 104.

As a result, the free length and the deflection of the wiper blade 108 may be controlled to compensate for the changes caused by the deformation of the wiper blade holder 106. In other words, the non-planar surface 402 may control or adjust an amount of deflection along a width of the wiper blade 108.

Figure 5A:
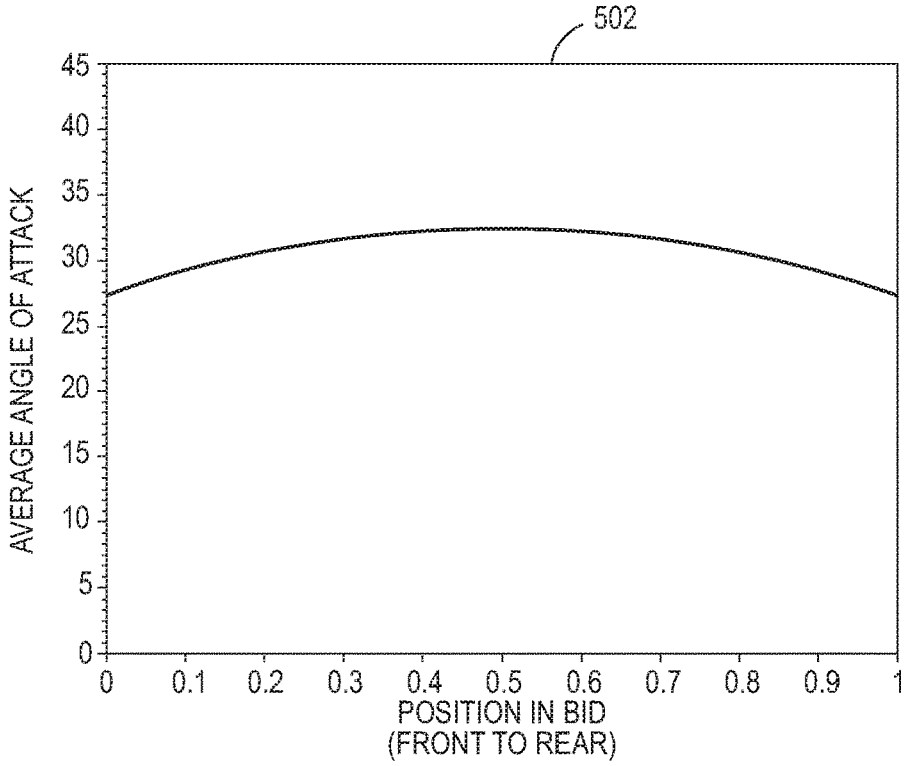
FIG. 5 (shown as FIG. 5A and FIG. 5B) illustrates an example graphical representation of an angle of attack with and without the apparatus of the present disclosure.
Figure 5B:
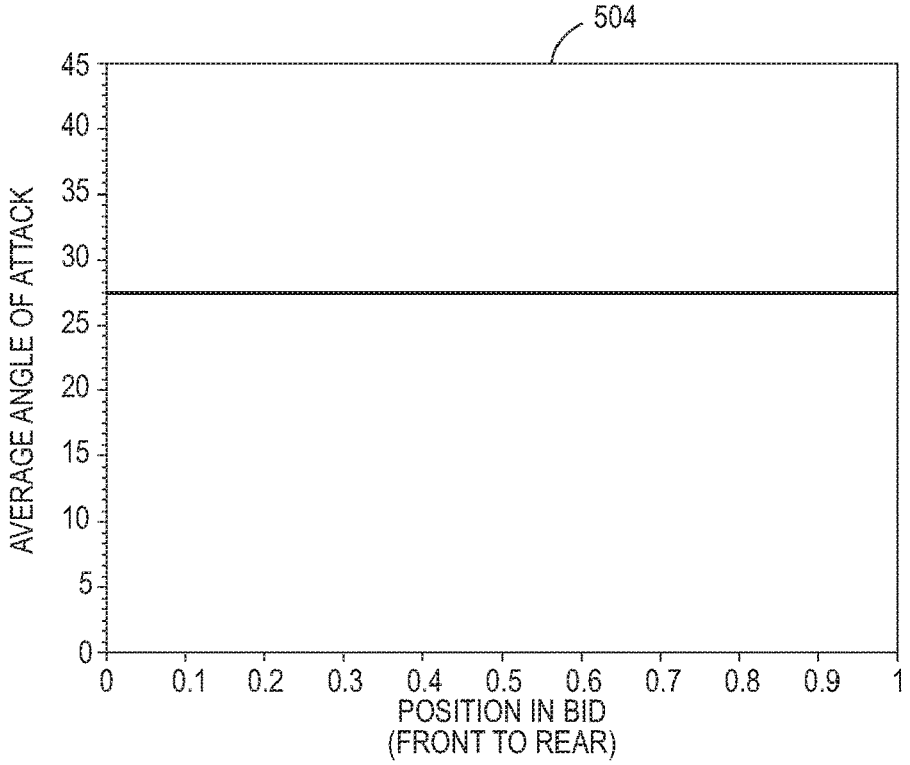

FIG. 5 (shown as FIG. 5A and FIG. 5B) illustrates a graphical representation of the average angle of attack from front to rear of the BID 100 with and without the apparatus of the present disclosure. For example, a graph 502 illustrates how the average angle of attack has a wide range moving from front to rear of the BID 100.

In contrast, a graph 504 illustrates an angle of attack using the curvature on the mounting surface 304. For example, the graph 504 illustrates a consistent average angle of attack from front to rear of the BID 100. In other words, the graphs 502 and 504 illustrate how the average angle of attack is improved across the wiper blade 108 and across the cleaner roller 104 using the wiper blade holders 106 of the present disclosure.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

The invention claimed is:

1. An apparatus, comprising:

a planar surface;

a mounting surface coupled adjacent to the planar surface; and a wiper blade clamped to the planar surface, wherein a bottom of the wiper blade rests on the mounting surface, wherein the mounting surface has a shape to cause an origin of an x, y axis to change along a z-axis within an x, y, z coordinate system relative to the planar surface.

2. The apparatus of claim 1, wherein the origin of the x, y axis is to change such that a free length of the wiper blade is different at a plurality of points along a width of the wiper blade.

3. The apparatus of claim 1, wherein the mounting surface is to cause the origin of the x, y axis to move higher along the z-axis.

4. The apparatus of claim 1, wherein the shape of the mounting surface comprises a parabolic curve.

5. The apparatus of claim 4, wherein an amount of curvature in the curved mounting surface is a function of an amount of pre-load force applied to the wiper blade.

6. An apparatus, comprising:

a non-planar surface;

a mounting surface coupled adjacent to the non-planar surface; and a wiper blade clamped to the non-planar surface, wherein the non-planar surface adjusts an amount of deflection and a free length along a width of the wiper blade, wherein a bottom of the wiper blade rests on the mounting surface, wherein the mounting surface has a shape to cause an origin of an x, y axis to change along a z-axis within an x, y, z coordinate system relative to the non-planar surface such that the free length of the wiper blade is different at a plurality of points along the width of the wiper blade.

7. The apparatus of claim 6, wherein the non-planar surface comprises a plurality of different curves along a width of the non-planar surface.

8. The apparatus of claim 7, wherein the origin of an x, y axis is changed to rotate left or right around the z-axis based on the plurality of different curves of the non-planar surface.

9. The apparatus of claim 7, wherein the plurality of different curves of the non-planar surface is based on amount of translation or rotation of the x, y axis that is desired at different locations along a width of the wiper blade.

10. The apparatus of claim 6, wherein the shape of the mounting surface comprises a parabolic curve.

11. The apparatus of claim 10, wherein an amount of curvature of the parabolic curve is a function of a width of a binary ink developer (BID), a stiffness of the wiper blade, a stiffness of a wiper blade holder and an amount of pre-load force that is applied.

12. The apparatus of claim 6, wherein the wiper blade applies a uniform amount of tip force and a uniform angle of attack along a width of a cleaner roller.

13. A binary ink developer (BID) section, comprising:

a developer roller;

a cleaner roller to clean excess printing fluid off of the developer roller;

a wiper blade to clean the cleaner roller;

a wiper blade holder comprising a mounting surface, wherein the wiper blade is clamped on the mounting surface of the wiper blade holder, wherein the mounting surface has a shape to cause an origin of an x, y axis to change along a z-axis within an x, y, z coordinate system relative to a surface of the wiper blade holder to provide a uniform angle of attack along a width of the cleaner roller.

14. The BID section of claim 13, wherein the shape of the mounting surface comprises a curvature.

15. The BID section of claim 14, wherein the wiper blade holder comprises a non-planar surface that adjusts an amount of deflection along a width of the wiper blade such that the wiper blade applies a uniform amount of tip force along a width of the cleaner roller.

* * * * *